US008752309B2

(12) United States Patent
Cashel et al.

(10) Patent No.: US 8,752,309 B2
(45) Date of Patent: Jun. 17, 2014

(54) STORAGE DEVICE FOR SHOELACE

(75) Inventors: Kevin M. Cashel, Canastota, NY (US); Carol Stanley, Charlottesville, VA (US)

(73) Assignee: Stash Sporting Goods, Inc., Charlottesville, VA (US)

( * ) Notice: Subject to any disclaimer, the term of this patent is extended or adjusted under 35 U.S.C. 154(b) by 544 days.

(21) Appl. No.: 13/102,707

(22) Filed: May 6, 2011

(65) Prior Publication Data

US 2012/0279088 A1 Nov. 8, 2012

(51) Int. Cl.
*A43B 23/26* (2006.01)
*A43C 7/00* (2006.01)

(52) U.S. Cl.
USPC ..... 36/136; 36/50.1; 24/712.2; 24/306

(58) Field of Classification Search
USPC ..... 36/50.1, 136; 24/712.2, 306
See application file for complete search history.

(56) References Cited

U.S. PATENT DOCUMENTS

| | | | | | |
|---|---|---|---|---|---|
| 2,022,554 | A | | 11/1935 | Williams | |
| 3,473,198 | A | | 10/1969 | Meier | |
| 4,571,854 | A | * | 2/1986 | Edens | 36/50.1 |
| 4,715,094 | A | | 12/1987 | Herdman | |
| 4,780,936 | A | * | 11/1988 | Brecher | 24/712.2 |
| 4,879,787 | A | * | 11/1989 | Walls | 24/712.2 |
| 4,949,437 | A | | 8/1990 | Anderson | |
| 4,999,888 | A | | 3/1991 | Miller | |
| 5,022,127 | A | | 6/1991 | Ang | |
| 5,042,119 | A | | 8/1991 | Williams | |
| 5,170,573 | A | * | 12/1992 | Clinch | 36/50.1 |
| 5,402,589 | A | | 4/1995 | Lubrani et al. | |
| 5,649,342 | A | | 7/1997 | D'Andrade et al. | |
| 5,671,517 | A | * | 9/1997 | Gourley | 24/712.1 |
| 5,718,021 | A | | 2/1998 | Tatum | |
| 5,778,500 | A | | 7/1998 | Illingworth | |
| 5,913,483 | A | | 6/1999 | Polk | |
| 6,000,111 | A | | 12/1999 | Deskins et al. | |
| 6,247,214 | B1 | | 6/2001 | Hyde | |
| 6,260,246 | B1 | | 7/2001 | Lampkins | |
| 6,338,186 | B1 | | 1/2002 | Kleinmann | |
| 6,560,831 | B2 | | 5/2003 | Schoen | |
| 6,588,078 | B2 | * | 7/2003 | Writt et al. | 24/712.2 |
| 6,601,323 | B2 | | 8/2003 | Tsujino et al. | |
| 6,684,543 | B2 | * | 2/2004 | Fernau | 40/636 |
| 6,952,864 | B2 | | 10/2005 | Moreno | |
| 6,988,298 | B2 | * | 1/2006 | Ternasky et al. | 24/712.3 |
| 7,003,903 | B2 | * | 2/2006 | Johnson | 36/136 |
| 7,395,586 | B1 | | 7/2008 | Gibson | |
| 7,398,580 | B1 | | 7/2008 | Miller, III | |
| 7,404,242 | B1 | | 7/2008 | Perler | |
| 7,444,724 | B1 | | 11/2008 | Perler | |
| 7,640,640 | B1 | | 1/2010 | Watkins | |
| 7,650,706 | B2 | | 1/2010 | Wartel et al. | |
| 7,676,957 | B2 | | 3/2010 | Johnson | |
| 7,779,519 | B2 | | 8/2010 | Ashwood, Jr. | |
| 8,397,357 | B1 | * | 3/2013 | Madey | 24/712.3 |
| 8,438,708 | B1 | * | 5/2013 | Tuck | 24/712.3 |
| 2004/0163285 | A1 | * | 8/2004 | Johnson | 36/136 |
| 2004/0244162 | A1 | | 12/2004 | Schneider | |
| 2006/0168850 | A1 | * | 8/2006 | Wartel et al. | 36/136 |
| 2010/0018018 | A1 | | 1/2010 | Tong | |

* cited by examiner

*Primary Examiner* — Marie Bays
(74) *Attorney, Agent, or Firm* — Hiscock & Barclay LLP

(57) ABSTRACT

In one embodiment, a storage device encloses the laces of footwear. The storage device comprises a lower member, an upper member, and a joint that permits articulated motion between the lower member and the upper member in a first direction along the longitudinal axis of the storage device. The upper member comprises an enclosure with an inner cavity that receives the laces therein. In one example, the outer member comprises a pair of closure members that articulate in a second direction toward the longitudinal axis.

20 Claims, 10 Drawing Sheets

STORAGE DEVICE FOR SHOELACE

BACKGROUND

1. Technical Field

This disclosure relates generally to footwear and, more particularly, to embodiments of a storage device that secures laces of the footwear.

2. Description of Related Art

Footwear comes in various types including footwear for athletics, work, formal dress, and the like. An element common among the types is the means for securing the footwear. Footwear typically deploys a lace or cord to draw the footwear about the foot of the wearer. In many cases, tying of the laces creates a knot and one or more loops or "bows." The loops often are left loose, swinging freely about the footwear as the wearer walks, runs, or otherwise executes motive action.

Unrestrained loops may pose a hazard. Free swinging laces may catch on low-lying impediments or, in some cases, can entangle with and between the wearer's feet. Longer laces create even larger loops that may drag on the ground. Dragging not only facilitates catching and hooking but can also cause the laces to become dirty and worn. For athletes and outdoorsman, the wearer's motive action is often more likely to result in untying and/or loosening of loops and laces that move freely. The wearer must often stop frequently to re-tie the laces, which is generally a nuisance but also more problematic when the laces loosen and untie during periods of activity.

Devices are known that capture the laces. Many of these devices, however, require that the laces penetrate or otherwise integrate with the device in order to secure the device to the footwear. Thus, while these solutions may alleviate problems with loose and dangling laces, the proposed devices have other shortcomings that cause other problems and/or may have features that cause disfavor and low adoption among wearers.

SUMMARY

Reducing and/or eliminating the need to re-tie laces is important to footwear consumers. The discussion below highlights embodiments of a storage device that reduces random motion of the laces, which motive action such as walking and running can induce. These embodiments can prevent the mechanics and dynamics that cause the laces to loosen and, ultimately, for the knot to become undone. In addition, the inventors propose a storage device that provides a robust solution to lace management and, in other words, addresses the problem of the lace dynamics that lead to untying and also other concerns such as usability, wearability, look, feel, adoption, and overall satisfaction.

Broadly stated, embodiments of the storage device can engage the laces of footwear without integration of the laces therein. Rather these embodiments can secure to the periphery the laces without interference with the natural traverse of the laces across the footwear from, e.g., eyelet to eyelet. This feature permits the wearer to remove the storage device without the need to perform extensive unlacing of the footwear.

Moreover, embodiments of the storage device can also secure and protect the laces such as within an enclosure. The enclosure provides sufficient clasping force to prevent relative motion of, e.g., the lace loops, that is often the cause of loosening and knot untying. The enclosure forms an inner cavity of varying dimensions so the wearer can deploy the storage device with footwear of various types and laces of various characteristics (e.g., thickness and length).

In one embodiment, a storage device comprises a body having a longitudinal axis, a lower member, and an upper member coupled to the lower member at a joint that permits movement of the upper member relative to the lower member along the longitudinal axis. The upper member comprises an enclosure with a peripheral wall that articulates towards the longitudinal axis to form an inner cavity in which shoelaces can be positioned.

In another embodiment, a footwear accessory comprises a panel of pliable material forming a lower member and an upper member, the upper member having a center section aligned with the lower member along a longitudinal axis and outer sections disposed along edges of the center section. The footwear accessory also comprises a fastening element secured to the panel of pliable material and positioned to permit the center section to be secured to the lower member and the outer sections to be secured to each other. In one example, the panel of pliable material is configured to permit relative movement of the lower member and the upper member along the longitudinal axis and relative movement of the outer sections towards the longitudinal axis to form an inner cavity in which shoelaces can be positioned.

In yet another embodiment, in footwear having a toe portion, a tongue member, and a lace portion in which laces can be positioned to traverse the lace portion from a first side to a second side, the lace portion having an upper end and a lower end closer to the toe portion than the upper end, an accessory comprises a lower member positioned proximate the tongue member. The accessory also comprises an upper member positioned with respect to the lower member so that the laces can traverse between the upper member and the lower member. In one example, the lower member is coupled to the upper member by a joint that permits movement of the upper member relative to the lower member in a first direction between the upper end and the lower end. In another example, the upper member comprises a peripheral wall that articulates in a second direction between the first side and the second side to form an inner cavity in which a portion of the laces can be positioned.

BRIEF DESCRIPTION OF THE DRAWINGS

For further understanding of the subject matter, reference is will be made to the following detailed description, which is to be read in connection with the accompanying drawings, in which.

Where applicable like reference characters designate identical or corresponding components and units throughout the several views, which are not to scale unless otherwise indicated.

DETAILED DESCRIPTION

Figure 1:
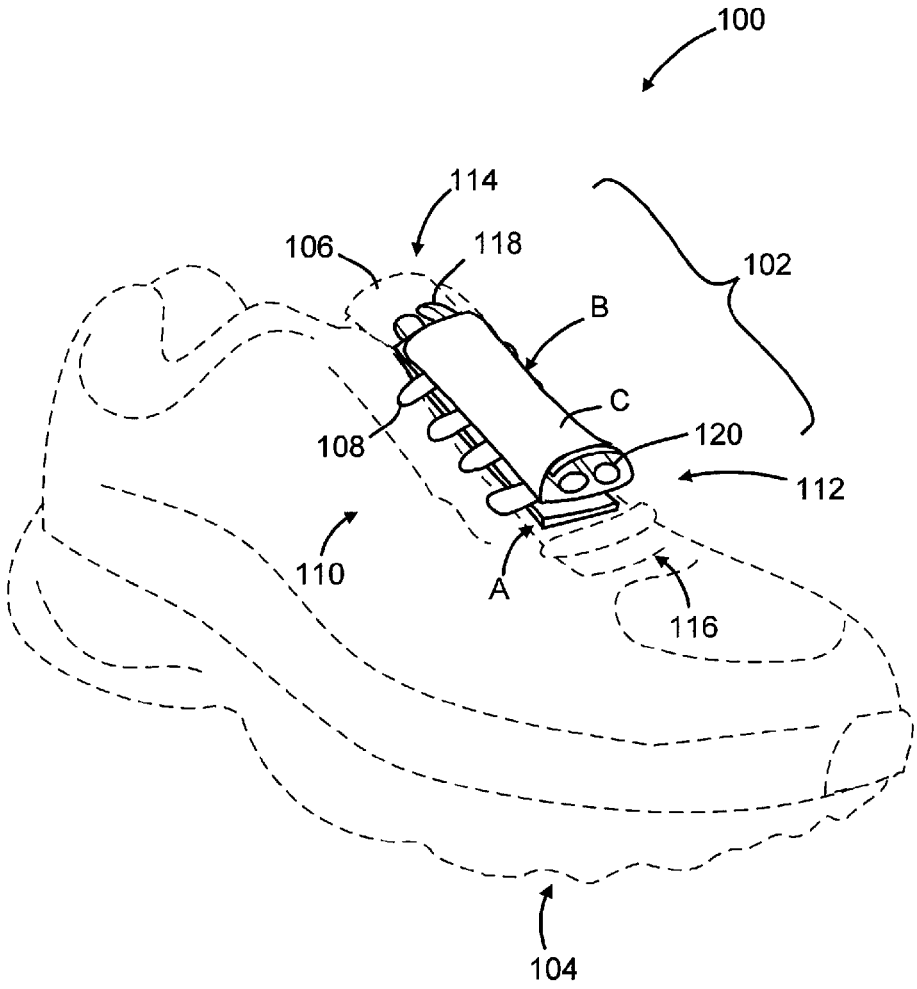
FIG. 1 is a top, perspective view of an exemplary embodiment of a storage device as implemented on footwear.

FIG. 1 depicts in general configuration an exemplary embodiment of a storage device 100 (also "accessory 100" or "footwear accessory 100"). The storage device 100 affixes to a lace portion 102 of footwear 104 such as, but not limited to, athletic shoes and sneakers, dress shoes, boots, and other footwear and apparel (e.g., hockey skates). The footwear 104 can have a tongue member 106 and laces 108. In FIG. 1, the laces 108 are shown in a "laced configuration" in which the laces 108 traverse the lace portion 102 both laterally from a first side 110 to a second side 112 and longitudinally from an upper end 114 to a lower end 116 closer to the toe portion of the footwear 104. For purposes of the present discussion, conventional tying of laces 108 will form a knot 118 at the upper end 114 and one or more lace loops 120, which extend from the knot 118 in various lengths based on, e.g., the type of footwear 104 and/or other preferences of a wearer. The discussion below details embodiments of the storage device 100 that secure and protect the laces 108 and, in one embodiment, the storage device 100 encloses the knot 118 and/or the lace loops 120.

At a high level, the storage device 100 comprises a resilient member A and an enclosure member B with an exposed portion C. The wearer can implement the storage device 100 on the footwear 104 in a generally downward direction from the upper end 114 to the lower end 116. However, rather than unlacing the laces 108 and re-lacing the laces 108 to secure the storage device 100 to footwear 104, in one implementation the wearer need only loosen the laces 108 to position the resilient member A adjacent the tongue member 106 and below the laces 108. To secure the storage device 100 in position, the wearer locates the enclosure member B above the laces 108 and engages the enclosure member B with the resilient member A. In one example, the enclosure member B can move relative to the resilient member A in a first direction from the upper end 114 to the lower end 116. Once the storage device 100 is in position, the wearer can tie the laces 108 to form the knot 118 and the lace loops 120. The wearer then positions the lace loops 120 in the enclosure member B. Exemplary embodiments of the storage device 100 permit the wearer to adjust the enclosure member B such as to change the size of the inner cavity to fit and secure the lace loops 120. In other embodiments, the storage device 100 may be integrated with the footwear 104. The tongue member 106 may be configured, for example, to receive the resilient member A therein or, in a still further example, the tongue member 106 may have features that interface with one or more of the resilient member A and the enclosure member B so as to secure the storage device 100 to the footwear 104.

The storage device 100 can be of sufficient size (e.g., length and width) to enclose the entirety of the lace loops 120. On the other hand, the storage device 100 can also enclose only a portion of the lace loops 120. In one example, the storage device 100 extends only a short distance from the upper end 114. Selection of the size of the storage device 100 may also reflect characteristics of footwear 104. The size can vary, for example, as between footwear for children and for adults. Moreover, the type of footwear can further determine the size of the storage device 100. For example, embodiments of the storage device 100 may accommodate laces found on, respectively, basketball shoes and dress shoes.

The storage device 100 may be prominent and visible when positioned on the footwear 104. In certain configurations, the storage device 100 may come in various colors schemes, material patterning, and other adornment that are visually appealing. Exposed portions of the storage device 100 such as the exposed portion C can, for example, have particular designs and ornamentation (e.g., tags, logos, trademarks, etc.). Some configurations of the storage device 100 may permit the wearer to select and modify the ornamentation as desired. In one embodiment, the exposed portion C may comprise panels or other components that the wearer can replace, wherein the components may display drawings, pictures, scenes, and like designs and ornamentation. In other embodiments, the exposed portion C may have features (e.g., a pocket) that permit the wearer to store and retain items such as, but not limited to, keys, medicines, and accessories (e.g., microchips, micro-processors, and the like).

Figure 2:
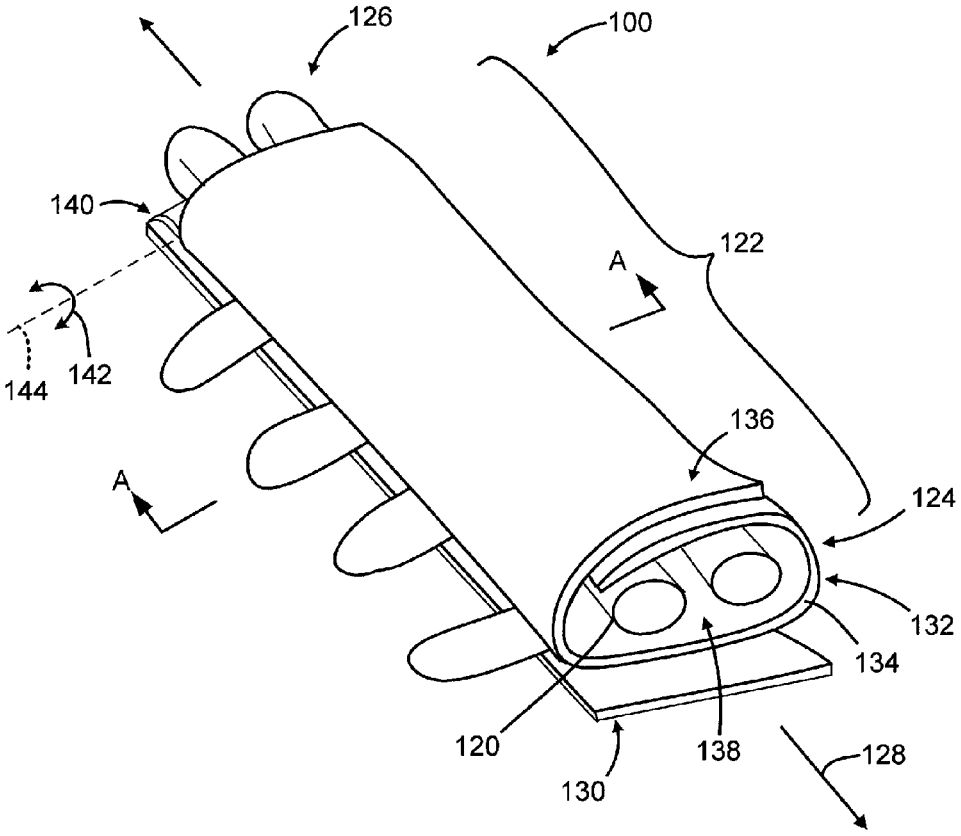
FIG. 2 is a detail, perspective view of the storage device of FIG. 2.
Figure 3:
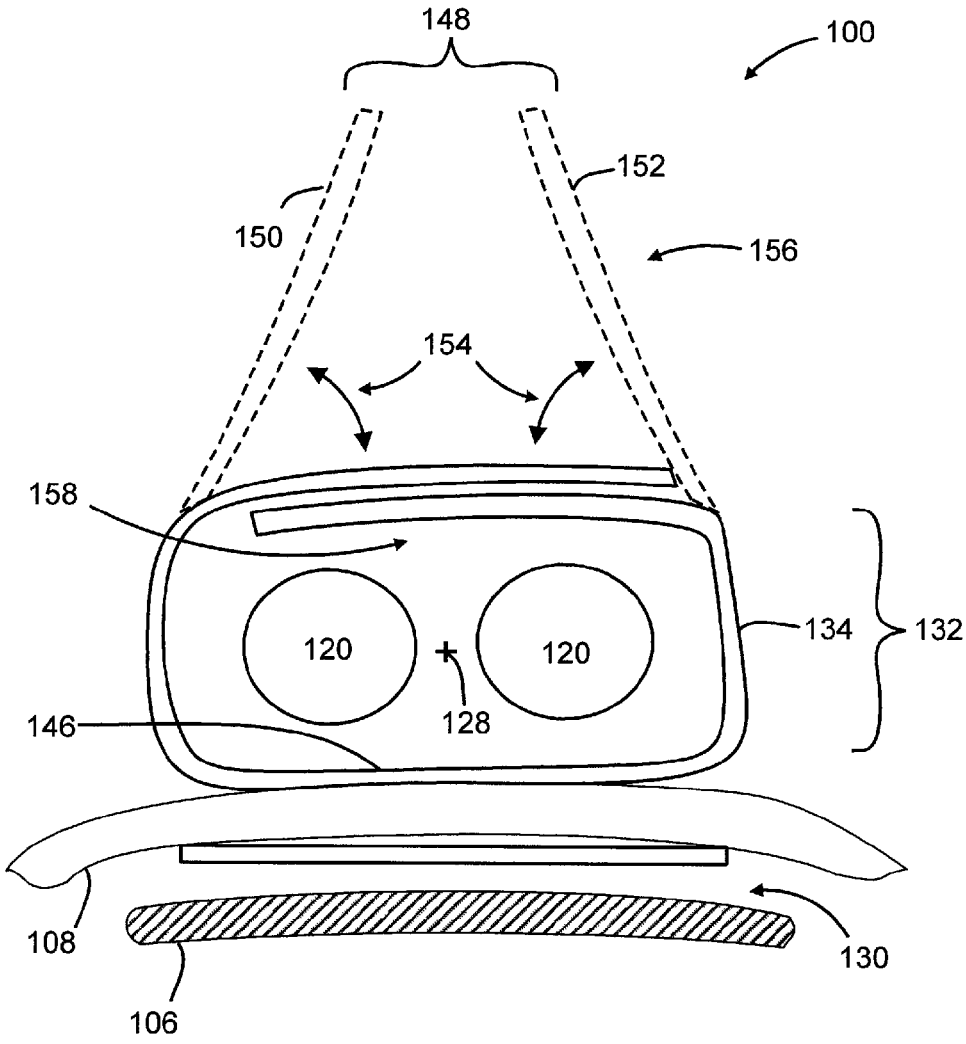
FIG. 3 is a front, cross-section view of the storage device of FIGS. 1 and 2.

FIGS. 2 and 3 provide additional details of the storage device 100 in a detailed view (FIG. 2) and a cross-section view (FIG. 3) taken along line B-B (FIG. 2). As best shown in FIG. 2, the storage device 100 can comprise a body 122 with a first end 124, a second end 126, and a longitudinal axis 128 that extends therebetween. The body 122 can comprise a lower member 130 and an upper member 132 with a peripheral wall 134 that forms an enclosure 136. The enclosure 136 has, in one example, an inner cavity 138 that receives the knot 118 and/or the lace loops 120 as the present disclosure discusses below.

The body 122 is open at the first end 124 and has a joint 140 at the second end 126. The joint 140 couples the lower member 130 to the upper member 132. While securing the members (e.g., the lower member 130 and the upper member 132) together, the joint 140 also permits relative motion between the members along the longitudinal axis 128. Relative motion can include rotation (identified by the numeral 142) about an axis 144. The axis 144 can be perpendicular (or orthogonal) to the longitudinal axis 128 as shown, however, the inventors also contemplate configurations in which the axis 144 can deviate from perpendicular in varying degrees. Likewise, the axis 144 provides, in one example, a general reference as to the origin about which the end user can manipulate and cause relative motion between the lower member 130 and the upper member 132. In some configurations, the joint 140 may be compliant, flexible, or otherwise non-rigid, thereby causing rotation 142 to define only the general relative movement of the members in the direction of (e.g., along) the longitudinal axis 128.

Relative movement (e.g., rotation 142) affords the storage device 100 a first degree of freedom to position and enclose the laces 108 between the lower member 130 and the upper member 132. For example, the end user can separate the lower member 130 from the upper member 132, which in turn opens or expands the open end (e.g., the first end 124). This feature permits the end user to advance the storage device 100 from the upper end 114 to the lower end of the 116 in the lace portion 102, and vice versa. In one implementation, the end user opens the storage device 100 a sufficient amount to allow the lower member 130 to slide between the tongue member 106 and the underside of the laces 108 and the upper member 132 to slide over the upper side of the laces 108. The end user advances the storage device 100 until the second end 126 is proximate the upper end 114. In one example, the joint 140 prevents further movement of the storage device 100, which indicates that the storage device is properly located in an "installed configuration" in the lace portion 102. When in position, the end user can secure the lower member 130 and the upper member 132 to one another, which secures the storage device 100 to the footwear 104 (FIG. 1).

FIG. 3 shows the tongue member 106 and the laces 108, which traverse between the lower member 130 and the upper member 132. In the present example, the peripheral wall 134 comprises a center portion 146 and one or more closure members 148. The closure members 148 comprise a first closure member 150 and a second closure member 152, which can move relative to the one another as well as relative to the longitudinal axis 128, as indicated by the arrows demarcated with the numeral 154. Movement 154 changes the position of the closure members 148. These changes include changes between a first position 156 and a second position 158 that forms the inner cavity 138 and encloses the knot (not shown) and the lace loops 120 therein. The first position 156, on the other hand, effectively exposes the inner cavity 138 so the end user can, e.g., position the lace loops 120 proximate the center portion 146 and enclose the lace loops 120 by moving the closure members 148 to the second position 158.

Movement 154 affords the storage device 100 with a second degree of freedom. In the present example, the closure members 148 articulate in a second direction, towards or medially, with respect to the longitudinal axis 128. Medial articulation can embody movement that is generally perpendicular to the longitudinal rotation (e.g., the rotation 142) of the lower member 130 and the upper member 132. However, in other embodiments, medial articulation can vary with respect to the longitudinal rotation. In one embodiment, the second degree of freedom may permit movement of the closure members 148 that is along the longitudinal axis 128. This movement can occur when one of the closure members 148 articulates from the lower end 116 to the upper end 114 of the lace portion 102.

The inventors contemplate various configurations of the closure members 148. While shown as a pair of members (e.g., the first closure member 150 and the second closure member 152), other configurations may utilize only one closure member that, in combination with the second degree of freedom, can form the inner cavity 138. Likewise, the closure members 148 can overlap, as shown in the present example, and/or can affix to one another at different positions and/or configurations with respect to one another. The amount of overlap can increase and decrease to accommodate different types, sizes, lengths, and other characteristics of the laces 108 and, more particularly, the lace loops 120.

In one embodiment, the storage device 100 can comprise a fastening element (not shown) in lieu of penetration (or integration) of the laces 108 with either the lower member 130 or the upper member 132. This fastening element permits the end user to insert and remove the storage device 100 from the lace portion 102 without the need to unlace the laces 108 from the laced configuration (FIG. 1). Generally the fastening element enables releasable engagement of the lower member 130 with the upper member 132. That is, the fastening element permits repeated engagement of the lower member 130 and the upper member 132, preferably without substantial degradation of securing force. Exemplary fastening elements can include various materials (e.g., hook-and-loop material such as VELCRO® and adhesive material) and devices (e.g., clasps, hasps, buttons, hooks, and the like). The fastening element can be found on one or both of the lower member 130 and the upper member 132, as well as on various parts of the storage device 100 as desired. In one example, the fastening element affixes to opposing surfaces of the lower member 130 and the upper member 132 to permit engagement of these opposing surfaces about the laces 108.

The lower member 130 and the upper member 132 lend themselves to construction using pliable materials such as fabrics and cloth. Other materials can include metals, plastics, and composites. Fabrics can comprise synthetic and non-synthetic fibers. In one example, the fabric comprises CORDURA® and/or derivations thereof. Certain characteristics of the storage device 100 such as water-resistance, wear-resistance, and reflectance may also require selection of certain materials over others. Because embodiments of the storage device 100 are consumer products, costs and pricing may influence the selection of materials and fabrication techniques. For example, fabric construction may require sewing and stitching, while other techniques such as molding and extruding may be useful when used in conjunction with plastics and related composites. Any of these techniques are useful to form the components of the storage device 100 monolithically such as by forming the lower member 130, the upper member 132, and the joint 140 as a single, unitary structure. This structure may be a panel of pliable material, although the inventors also understand that other configurations with multiple panels are possible such as if construction takes the form of separate pieces and sub-assemblies, which are secured together as those artisans skilled in the consumer product arts will recognize.

The lower member 130 can exhibit certain material properties that resist distortions such as flexure, crumpling, crimping, and buckling. This distortion may occur, for example, when the end user affixes the storage device 100 to footwear 104. These properties can facilitate insertion and placement of the storage device 100 in the installed configuration in the lace portion 102. The lower member 130 may, for example, exhibit greater resiliency and/or stiffness as compared to, e.g., cloth, fabric, and the like. These properties can arise from the materials that are used to construct the lower member 130. Other construction may use certain material treatments and coatings that enhance resiliency and/or stiffness. In one embodiment, the lower member 130 may comprise one or more elements of the same or varying stiffness, wherein the combination of such elements provide the lower member 130 with the desired properties. In another embodiment, the lower member 130 may exhibit a first stiffness and the upper member 132 may exhibit a second stiffness, wherein the first stiffness is greater than the second stiffness, and still further wherein the first stiffness is greater than the stiffness of fabric.

Figure 4:
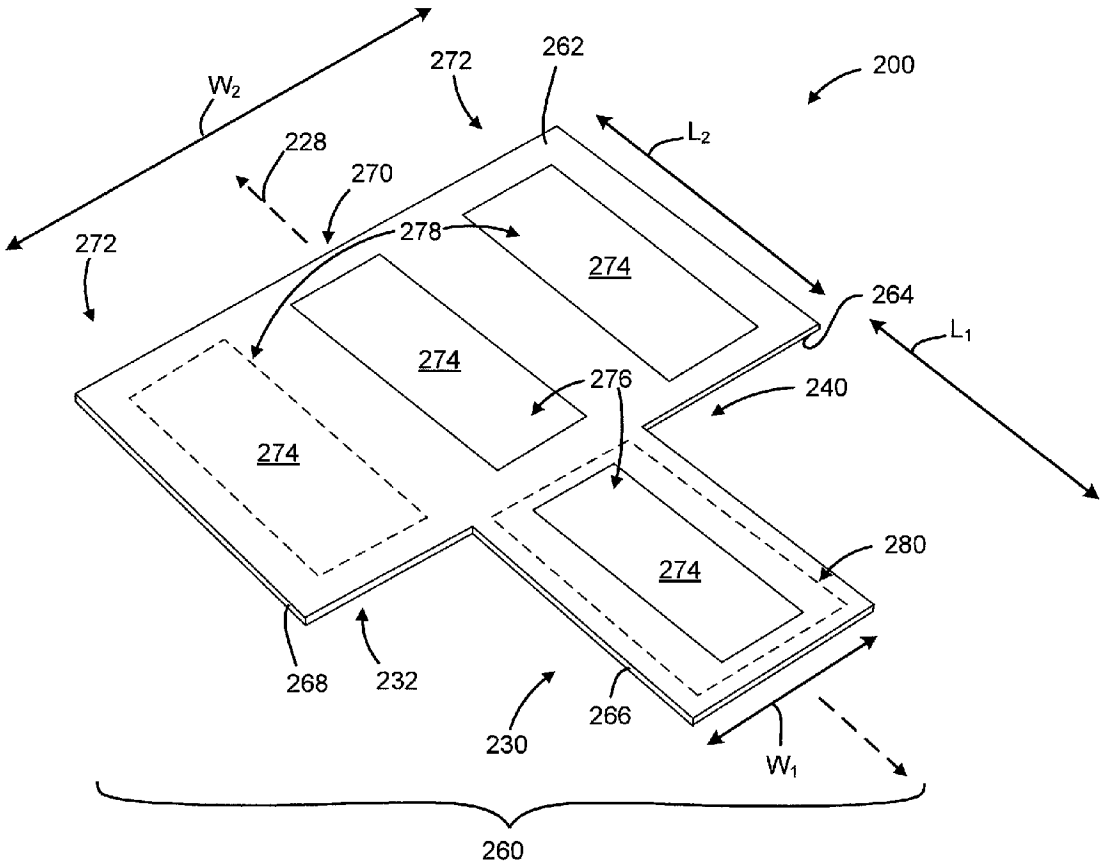
FIG. 4 is a top, perspective view of another exemplary embodiment of a storage device.

FIG. 4 illustrates another exemplary embodiment of a storage device 200. Like numerals are used to identify like components as between FIGS. 1-3 and FIGS. 4 and 5, except the numerals are increased by 100. In FIG. 4, the storage device 200 can comprise a longitudinal axis 228, a lower member 230, an upper member 232, and a joint 240. The storage device 200 is shown in an "uninstalled configuration" as opposed to the installed configuration of FIGS. 1-3.

The storage device 200 embodies a planar body 260 (or "a panel 260") that can comprise pliable material (e.g., fabric). The panel 260 has a top planar surface 262 and a bottom planar surface 264, reference to which is not limiting but rather is used for to identify certain configurations and embodiments of the storage device 200. The panel 260 forms a resilient member 266 and a deformable member 268 with a center section 270 and a pair of outer sections 272. The panel 260 also comprises fastening areas 274 that include a first fastening area 276 on the top planar surface 262 and a second fastening area 278 on each of the top planar surface 262 and the bottom planar surface 264. In one embodiment, the resilient member 266 comprises a spine member 280 that may prevent distortion of the resilient member 266. The spine member 280 may be made of plastic or other lightweight material and/or materials that the present disclosure contemplates herein.

Each of the first fastening area 276 and the second fastening area 278 can be located on opposing surfaces, such as opposing surfaces of the resilient member 266 and the center section 270 and opposing surface of the outer sections 272. This construction facilitates securing of the storage device 200 to the footwear and about the laces and the lace loops. For example, the first fastening area 276 can secure the lower member 230 to the upper member 232 about the portion of the laces (e.g., the laces 108) that laterally traverse the lace portion (e.g., the lace portion 102). The second fastening area 278 can likewise secure the outer sections 272 to form the enclosure (e.g., the enclosure 136) about the lace loops (e.g., the lace loops 120).

The fastening areas 274 can vary in construction, size, and location on the panel 260. Each of the fastening areas 274 may comprise a plurality of smaller areas. The smaller areas may be indicative of characteristics of the fastening element such as the type (e.g., hook-and-loop, button or snap) or physical properties (e.g., securing force). For example, the first fastening area 276 may be strategically arranged to avoid the laces that laterally traverse the lace portion but also permit engagement of the opposing surfaces on which the first fastening area 276 is found.

As set forth above, the fastening element can comprise hook-and-loop material of varying density and construction. This material may cover the entire surface area exposed on the top planar surface 262 and the bottom planar surface 264 of the resilient member 266 and/or the deformable member 268. However, the inventors recognize that this extensive coverage may not be necessary or feasible within desired cost and performance constraints. Rather the size of the fastening areas 274 can assume a percentage of the surface area that is available for each particular location on the panel 260. For example, the first fastening area 276 and/or the second fastening area 278 may cover less than 25% of the surface area of the resilient element 266, the center section 270, and the outer sections 272. In other examples, the first fastening area 276 and/or the second fastening area 278 may cover at least about 75%, and in one construction from about 85% to about 95% of the respective surface area on which the fastening areas 274 are located. Alternative constructions may likewise mix, match, and vary these percentages, with the selected percentages providing adequate securing forces as desired.

Exemplary constructions of the panel 260 comprise fabric (e.g., CORDURA®) or other compliant and pliable materials. The fabric can form a single, unitary piece or, in other configurations, each part of the panel 260 (e.g., the resilient member 266 and the deformable member 268) is separately formed and assembled together (e.g., by stitching). When separately assembled, the design of the storage device 200 can also incorporate parts of different materials for each of the resilient member 266 and the deformable member 268 such as fabric and plastic, fabric and fabric, and other like combinations.

For fabric construction, the outer edges of the panel 260 will often comprise stitching to prevent fraying or other degradation of the material. Other preventative methods such as plastics, adhesives, and coatings can be used in conjunction with the stitching and/or as a stand-alone methodology to maintain the integrity of the fabric. An adhesive can attach the e.g., the hook-and-loop material to the fastening areas 274, although some constructions may require additional stitching to ensure secure placement.

Figure 5:
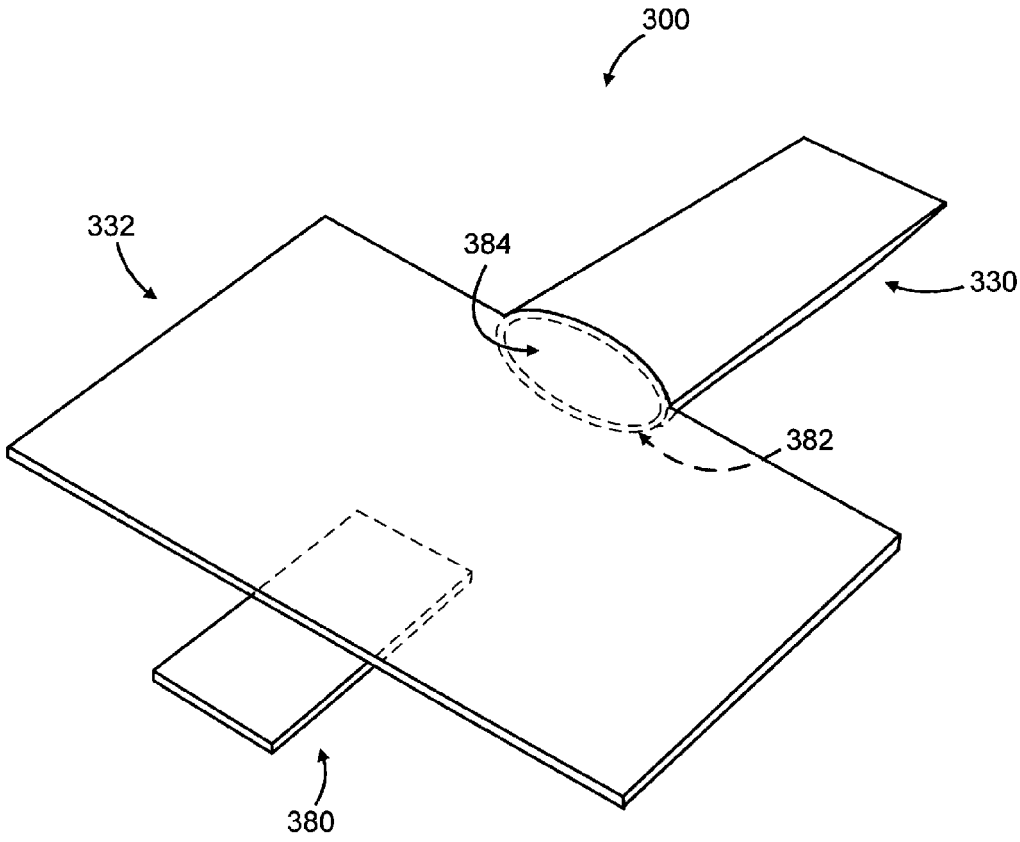
FIG. 5 is a front, cross-section view of the storage device of FIG. 4.

The panel 260 can have the general shape that FIG. 4 depicts, with dimensions (e.g., length L and width W) designated thereto. Generally the deformable member 268 may be about three (3) times as wide as the resilient member 266. In other examples, the panel 260 can have nominal dimensions that are set forth for the resilient member 266 and the deformable member 268 as follows below:

Resilient Member 266: Length $L_1$ from about 30 mm to about 85 mm Width $W_1$ from about 12 mm to about 40 mm Deformable member 268: Length $L_2$ from about 30 mm to about 85 mm Width $W_2$ from about 70 mm to about 95 mm FIG. 5 depicts another exemplary embodiment of a storage device 300. In FIG. 5, the storage device 300 is shown in exploded assembly form, and comprises a lower member 330, an upper member 332, and a spine member 380. The lower member 330 comprises a pocket 382 with an opening 384 which is sized and configured to receive the spine member 380 therein. The spine member 380 may extend the length of the lower member 330 as a single piece or as multiple pieces. In the latter construction, i.e., multiple pieces, the spine member 380 can be secured to the lower member 330 such as by adhesive and/or stitching in lieu of the pocket 382. In one embodiment, the pocket 382 provides access to the spine member 380 for a wearer to remove and replace the spine member 380 from the lower member 330. This access may occur by way of the opening 384, which in one example is proximate the interface of the lower member 330 and the upper member 332.

Figure 6:
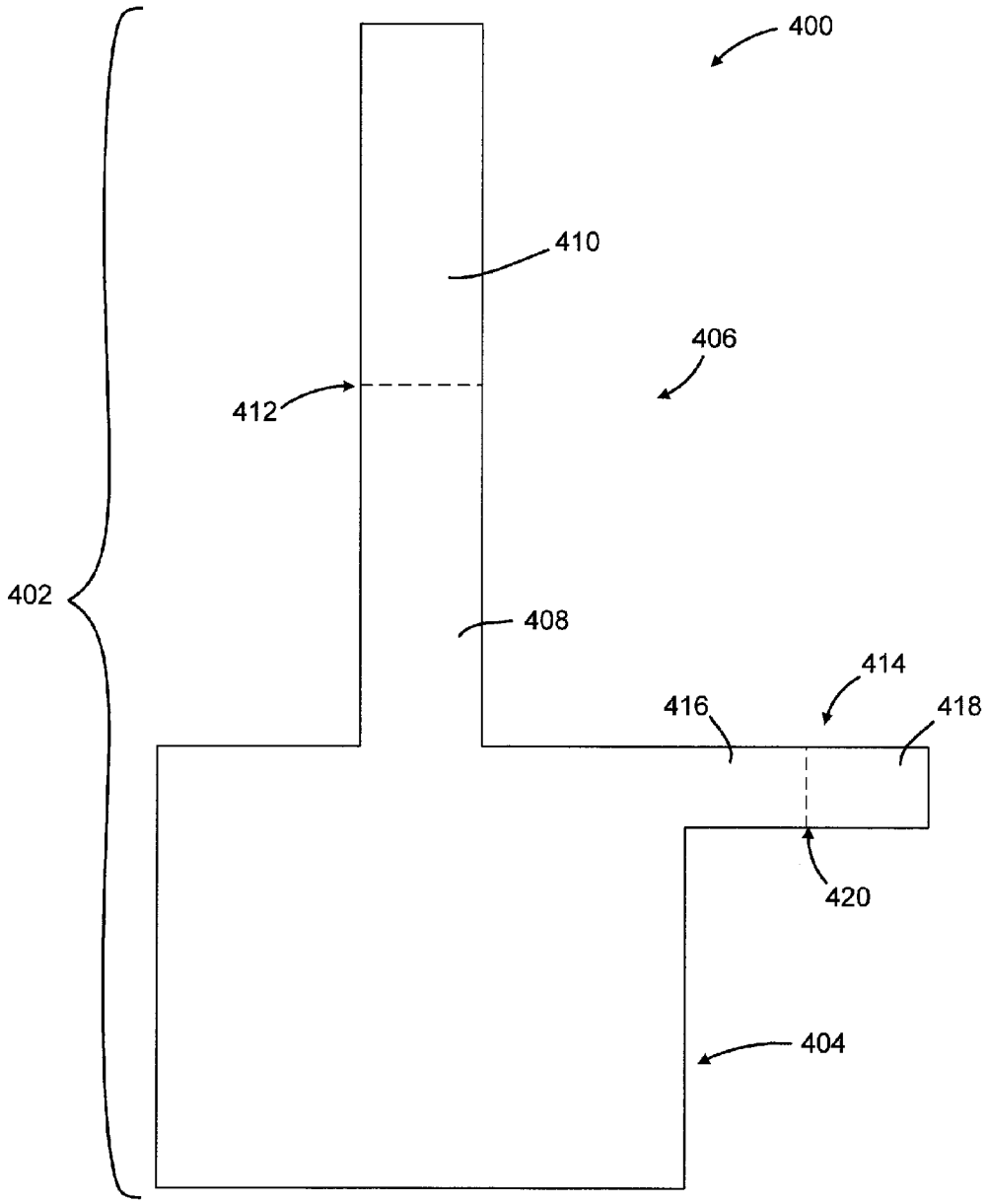
FIG. 6 is a top, plane view of an example of a material blank that forms the storage devices of the present disclosure.
Figure 7:
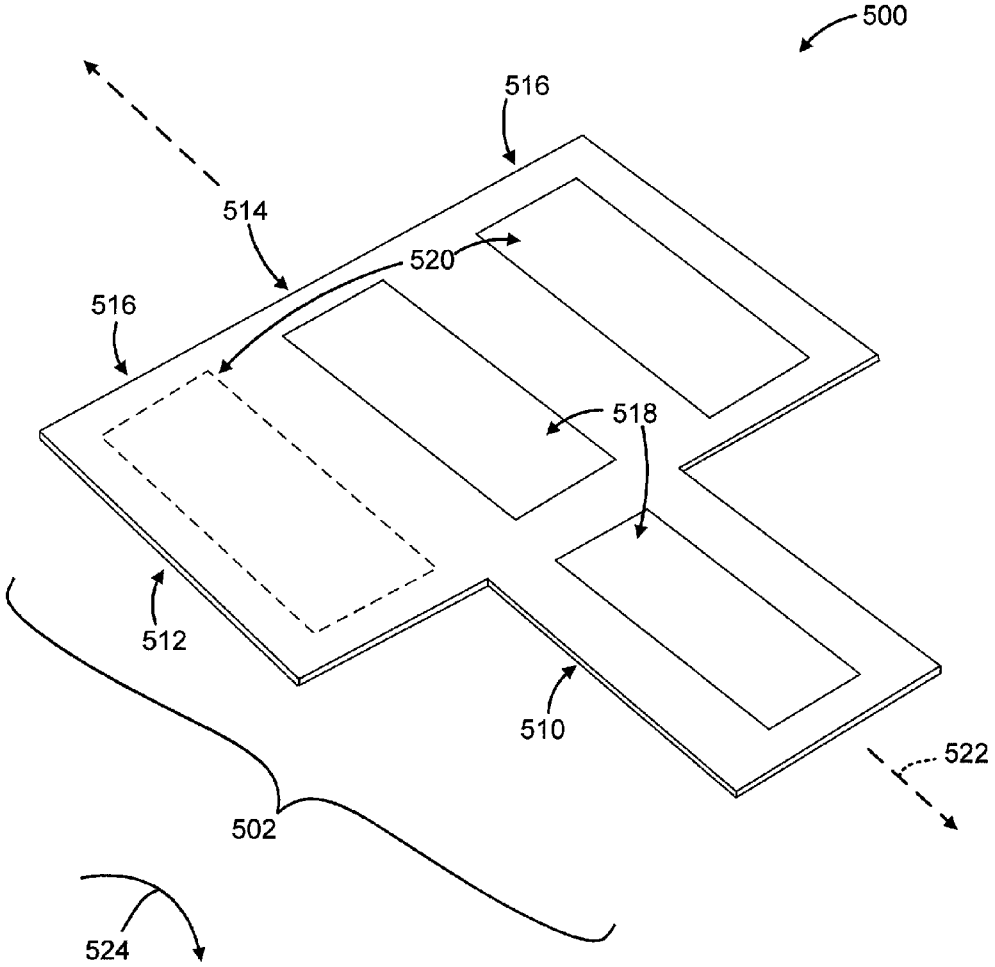
FIG. 7 is a top, perspective view of yet another embodiment of a storage device in a first configuration.

FIG. 6 depicts an example of a material blank 400 that can form the storage devices as the discussion provides below. In one embodiment, the material blank 400 comprises a form factor 402 with an upper portion 404 and a lower portion 406. The lower portion 406 has first material area 408, proximate the upper portion 404, a second material area 410, and a first fold line 412 that delineates between the first material area 408 and the second material area 410. The upper portion 404 has a tab member 414 that extends from at least one edge. The tab member 414 can comprise a first tab area 416, a second tab area 418, and a second fold line 420 that separates the two areas.

In one embodiment, the second material area 410 can fold about the first fold line 412 to a position under the first material area 408. Stitching or other fastening means can be used to secure the periphery of each of the areas (e.g., the area 408 and the area 410). This construction can form a pocket, which may extend from a location proximate the upper portion 404 to a location proximate the first fold line 412.

The tab member 414 is generally configured for the wearer to clasp (such as between the thumb and forefinger). This element facilitates opening and closing of the enclosure, thereby permitting ready access to the shoelaces that may be positioned and enclosed therein. The tab member 414 may be integrated with the material blank 400, and located in various positions as desired. The inventors contemplate other configurations, however, in which the tab member 414 may be a separate element that is secured to the upper portion 404 or otherwise included as part of the storage device. In one example, the second tab area 418 can fold about the second fold line 420 to a position below the first tab area 416. As discussed above, stitching or other fastening means can secure the first tab area 416 to the second tab area 418.

Figure 8:
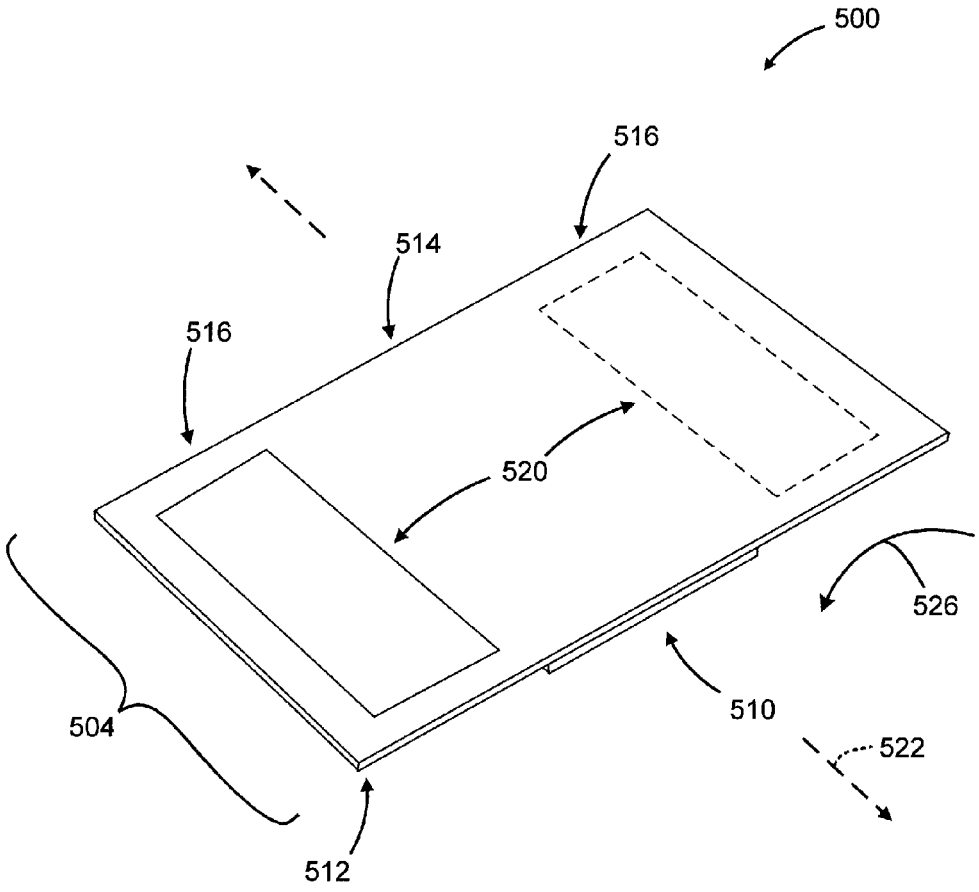
FIG. 8 is a top, perspective view of the storage device of FIG. 6 in a second configuration.
Figure 9:
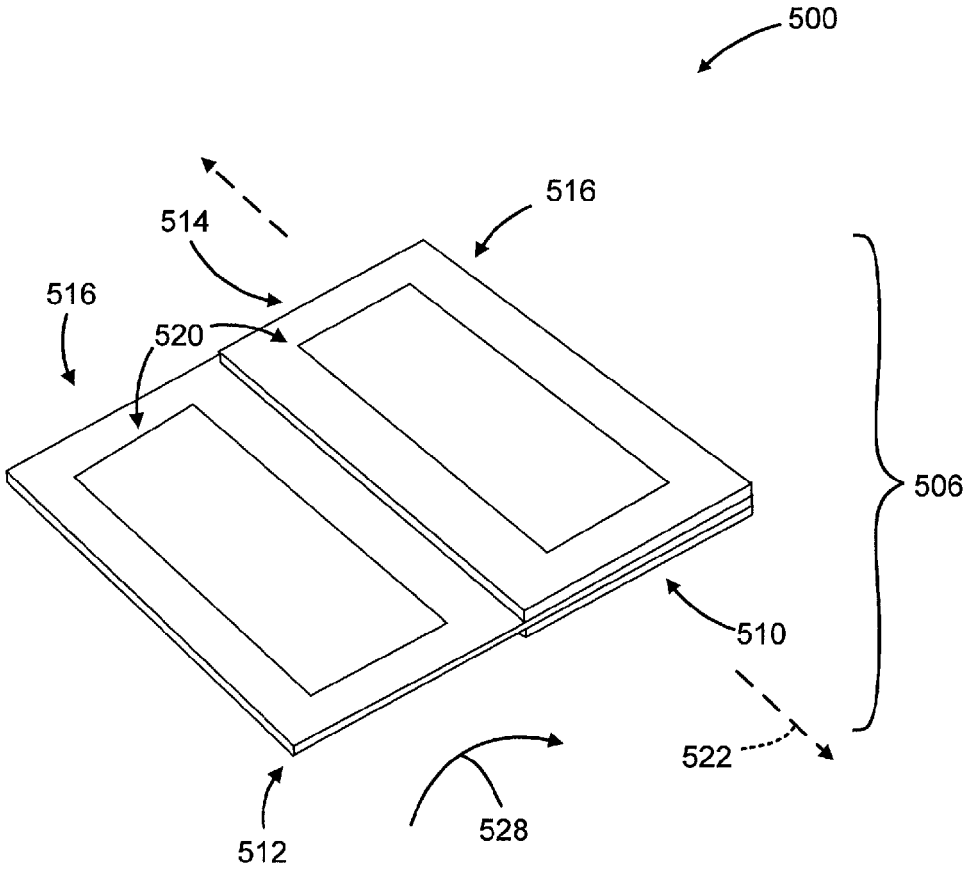
FIG. 9 is a top, perspective view of the storage device of FIG. 6 in a third configuration.
Figure 10:
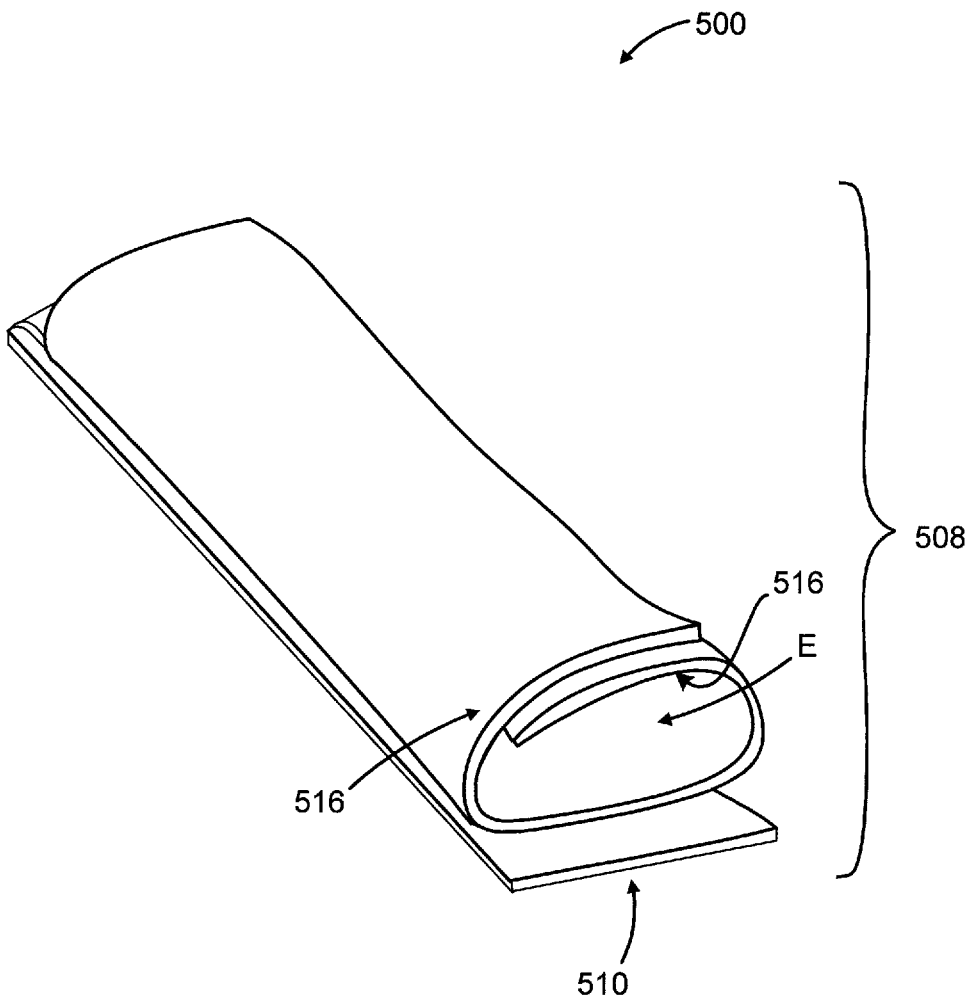
FIG. 10 is a top, perspective view of the storage device of FIG. 6 in a forth configuration.

FIGS. 7-10 depict another exemplary embodiment of a storage device 500. The storage device 500 appears in various configurations, which the discussion below uses to describe implementation of the storage device 500 on footwear. The configuration include a first configuration 502 (FIG. 7), a second configuration 504 (FIG. 8), a third configuration 506 (FIG. 9), and a fourth configuration 508 (FIG. 10). The storage device 500 comprises a resilient member 510 and a deformable member 512 with a center section 514 and opposing sections 516. The storage device 500 also has a first fastening area 518 and a second fastening area 520. In one embodiment, the center section 514 is configured to prevent or reduce movement of the shoelaces. The center section 514 can exhibit higher friction properties, for example, against which the shoelaces are positioned. This higher friction property can be the result of the properties of the material of construction, or be added such as by securing an element of material with high friction properties.

In the first configuration 502, the storage device 500 exposes the first fastening area 518 and a portion of the second fastening area 520. The wearer can position the resilient member 510 in the lace portion of the footwear, while the center section 514 and the opposing sections 516 maintain a substantially planar relationship with respect to one another and the resilient member 510. This planar relationship takes into consideration the pliable nature of the fabrics that may be used for construction. In one embodiment, once the resilient member 510 is located in position in the lace portion, the deformable member 512 can undergo a first articulation along a longitudinal axis 522 toward the resilient member 510, as generally identified by the numeral 524.

Turning next to FIG. 8, the first articulation 524 places the storage device in the second configuration 504. Here, the first fastening area 518 can secure the center section 514 to the resilient member 510. The engagement of these two elements exposes a portion of the second fastening area 520 that is found on the bottom surface of the deformable member 512. In one embodiment, the deformable member 512 can undergo a second articulation 526, wherein one of the opposing sections 516 articulates towards the center section 514. When positioned on footwear, the laces that laterally traverse the lace portion will be located between the resilient member 510 and the center section 514.

The third configuration 506 of FIG. 9 results from the second articulation 526. The third configuration 506 exposes each portion of the second fastening area 520. In one example, one of the opposing sections 516 remains in the original planar relationship with the center section 514, while the other opposing section 516 forms a portion of the inner cavity in which the lace loops are to be secured. In one embodiment, the deformable member 512 can undergo a third articulation 528, wherein the opposing section 516 not yet articulated is displaced towards the center section 514.

FIG. 10 illustrates an example of the fourth configuration 508, which can result from the third articulation 528. In the fourth configuration 508, the opposing sections 516 overlap above the center section 514 to form the enclosure E. The second fastening area 520 secures the opposing sections 516 to maintain the storage device 500 in the fourth configuration 508. The resulting enclosure E is sized and configured so that shoelaces can be positioned therein.

In view of the forgoing, embodiments of the storage devices have been described that are useful to prevent inadvertent untying and loosening of shoelaces. These embodiments also protect the shoelaces from wear and soiling. In some embodiments, the storage device further acts as an aesthetic accessory, which may enclose the shoelaces in a manner that conceals all or a portion of the shoelaces from view.

Where applicable it is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

This written description uses examples to disclose embodiments of the invention, including the best mode, and also to enable any person skilled in the art to practice the invention, including making and using any devices or systems and performing any incorporated methods. The patentable scope of the invention is defied by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A storage device, comprising:

a body having a longitudinal axis, a lower member, and an upper member coupled to the lower member at a joint that is configured for a first degree of freedom to permit movement of the upper member relative to the lower member in a first direction along the longitudinal axis, the upper member comprising an enclosure with a peripheral wall having outer sections that are configured with a second degree of freedom to articulate in a second direction towards the longitudinal axis, wherein the outer sections couple with one another to form an inner cavity with a first open end and a second open end disposed on the longitudinal axis and configured for shoelaces to be positioned.

2. A storage device according to claim 1, wherein the lower member has a first stiffness that is greater than a second stiffness of the upper member.

3. A storage device, comprising:

a body having a longitudinal axis, a lower member, and an upper member coupled to the lower member at a joint that is configured to permit movement of the upper member relative to the lower member along the longitudinal axis, the upper member comprising an enclosure with a peripheral wall that is configured to articulate towards the longitudinal axis to form an inner cavity in which shoelaces can be positioned, wherein the body comprises material that is pliable, and wherein the lower member has a first stiffness that is greater than a second stiffness of the upper member.

4. A storage device according to claim 3, wherein the material comprises fabric.

5. A storage device according to claim 3, further comprising a fastening element that is configured to secure the lower member to the upper member.

6. A storage device according to claim 5, wherein the fastening element is disposed on the peripheral wall.

7. A storage device according to claim 3, wherein the peripheral wall comprises closure members that form the inner cavity, and wherein the closure members include a first closure member and a second closure member located on opposite sides of the longitudinal axis.

8. A storage device according to claim 7, wherein the lower member and the upper member are formed monolithically.

9. A footwear accessory, comprising:

a panel of pliable material forming a body with a lower member and an upper member, the upper member having a center section aligned with the lower member along a longitudinal axis and outer sections disposed along edges of the center section; and a fastening element secured to the panel of pliable material and configured to permit the center section to be secured to the lower member and the outer sections to be secured to each other, wherein the panel of pliable material is configured for a first degree of freedom to permit relative movement of the lower member and the upper member in a first direction along the longitudinal axis and a second degree of freedom to permit relative movement of the outer sections in a second direction towards the longitudinal axis, wherein the outer sections couple with one another to form an inner cavity with a first open end and a second open end disposed on the longitudinal axis and configured for shoelaces to be positioned.

10. A footwear accessory, comprising:

a panel of pliable material forming a lower member and an upper member, the upper member having a center section aligned with the lower member along a longitudinal axis and outer sections disposed along edges of the center section;

a fastening element secured to the panel of pliable material and positioned to permit the center section to be secured to the lower member and the outer sections to be secured to each other; and a spine member proximate the lower member, wherein the spine member is configured with a stiffness that prevents distortion of the lower member, and wherein the panel of pliable material is configured to permit relative movement of the lower member and the upper member along the longitudinal axis and relative movement of the outer sections towards the longitudinal axis to form an inner cavity in which shoelaces can be positioned.

11. A footwear accessory according to claim 10, wherein the lower member has a pocket with an opening through which the spine member is received.

12. A footwear accessory according to claim 10, wherein the spine member is removable from the lower member.

13. A footwear accessory according to claim 10, wherein the panel of pliable material comprises fabric.

14. A footwear accessory according to claim 10, wherein the fastening element comprises hook-and-loop material.

15. A footwear accessory according to claim 10, further comprising a tab member disposed on upper member and extending from a portion of the panel member.

16. A footwear accessory according to claim 15, wherein the tab member is formed integrally with the panel of pliable material.

17. An accessory for footwear having a toe portion, a tongue member, and a lace portion in which laces can be positioned to traverse the lace portion from a first side to a second side, the lace portion having an upper end and a lower end closer to the toe portion than the upper end, said accessory comprising:

a body with a lower member that is configured to position proximate the tongue member and an upper member positioned with respect to the lower member and configured so that the laces traverse between the upper member and the lower member, wherein the lower member is coupled to the upper member by a joint that is configured for a first degree of freedom to permit movement of the upper member relative to the lower member in a first direction between the upper end and the lower end of the lace portion, and wherein the upper member comprises a peripheral wall having outer sections that are configured with a second degree of freedom to articulate in a second direction between the first side and the second side of the lace portion, wherein the outer sections couple with one another to form an inner cavity with a first open end and a second open end disposed on the longitudinal axis and configured for a portion of the laces to be positioned.

18. An accessory according to claim 17, further comprising a spine member that is configured to prevent buckling of the lower member.

19. An accessory according to claim 17, further comprising a fastening element secured to each of the upper member and the lower member, wherein the fastening element is positioned to secure the upper member to the lower member.

20. An accessory according to claim 17, wherein the accessory is integrated into the footwear.

* * * * *